US007104811B2

(12) United States Patent
Sakata et al.

(10) Patent No.: US 7,104,811 B2
(45) Date of Patent: Sep. 12, 2006

(54) ANGLED TERMINAL WITH FLANGE FOR COOPERATION WITH PRESS-FIT JIG

(75) Inventors: Tomoyuki Sakata, Mie (JP); Ryousuke Shioda, Mie (JP); Kensaku Takata, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/886,701

(22) Filed: Jul. 9, 2004

(65) Prior Publication Data

US 2005/0014424 A1 Jan. 20, 2005

(30) Foreign Application Priority Data

Jul. 9, 2003 (JP) ..... 2003-194414
Jul. 1, 2004 (JP) ..... 2004-195101

(51) Int. Cl.
*H01R 9/09* (2006.01)

(52) U.S. Cl. ..... 439/79; 439/943

(58) Field of Classification Search ..... 439/79, 439/80, 943

See application file for complete search history.

(56) References Cited

U.S. PATENT DOCUMENTS 3,742,432 A * 6/1973 Curtis et al. ..... 439/882
4,550,962 A * 11/1985 Czeschka ..... 439/78
4,568,136 A * 2/1986 Reuss ..... 439/629
5,080,596 A * 1/1992 Viselli et al. ..... 439/79
5,400,502 A 3/1995 Ota et al.
5,453,016 A * 9/1995 Clark et al. ..... 439/79
5,848,920 A * 12/1998 Klein et al. ..... 439/885
6,062,877 A 5/2000 Makino et al.
6,422,878 B1 * 7/2002 Pape et al. ..... 439/78
6,790,054 B1 * 9/2004 Boonsue ..... 439/79
6,866,523 B1 * 3/2005 Yamashita ..... 439/79

* cited by examiner

*Primary Examiner*—Neil Abrams
(74) *Attorney, Agent, or Firm*—Oliff & Berridge, PLC

(57) ABSTRACT

A bent connector terminal with improved stability when held within a groove (23) of a comb-shaped, press-fit jig (20,22), the terminal aligned with a hole (32) of a printed circuit board (30) and to be press-fitted into the hole. In one embodiment, at least one widened portion (12*e*) is formed on the connector terminal between a tip flange part (12*b*) and a swelled or widened part (12*c*), the widening of the part (12*c*) caused by bending of the connector terminal. The widened portion (12*e*) and the swelled part (12*c*) serve to stabilize the connector terminal within the groove (23) of the press-fit jig as the jig is used to press on the tip flange part (12*b*). In another embodiment, the connector terminal includes notches (12*d*) at the location where the connector terminal is to be bent, to compensate for widening caused by the bending step so that no swelled or broadened area is produced at this region. In this embodiment, since no widening is produced at the bent region the press-fit jig grooves may be narrowed so that the bent connector terminal is supported evenly between the bend and the flange part (12*b*) and stability is improved.

5 Claims, 6 Drawing Sheets

ANGLED TERMINAL WITH FLANGE FOR COOPERATION WITH PRESS-FIT JIG

BACKGROUND OF THE INVENTION

1. Field of the Invention

The invention relates to a connector terminal material used for a press-fit connector, a connector terminal, a method for producing a connector terminal, and a method for producing a substrate with a connector.

2. Description of the Related Art

FIGS. 6 are illustrations showing one example of a state before a terminal of a conventional press-fit connector is press-fitted to a substrate. FIG. 6A is a front view including a section along a terminal array of a front side. FIG. 6B is a side view. Void arrow marks shown in FIG. 6 show the mounting direction of each part at the time of press fitting. Conventionally, a so-called press-fit connector is widely used as a connector which can be simply connected by press-fitting a terminal to a substrate without soldering. For instance, a method of press-fitting the terminal shown in FIGS. 6 is known. In this method, the flange part 512*b* of each terminal 512 is pushed by the pressed surface 521 of the connector fixture 520 with a plurality of terminals 512 having flange parts extending from the housing 511 of the press-fit connector 510 interposed in comb-teeth lined in the lateral direction (the right and left direction of FIG. 6A of the connector fixture 520. An elastic part 512*a* swelled in a needle shape at the vicinity of the end part of each terminal 512 is press-fitted into penetrating hole 532 formed in the substrate body 531 of the printed circuit board 530 (This method is similarly adopted for a so-called pin connector which solders each terminal to the substrate (for instance, pin connectors described in JP-A-6-224597 or JP-A-10-41026). Numeral 550 shown in FIG. 6 designates a substrate fixture with which the printed circuit board 530 is brought into contact from the back thereof at the time of press-fitting, and the end of each terminal 512 is entered into a bottomed hole 552 formed in the fixture body 551, and the end of each terminal 512 is protected. The comb-teeth of the connector fixture 520 are composed by a deep groove 523, and a shallow groove 524. The deep groove 523has an inducing part 523*b* which induces the terminal 512 and has a slope surface, and a guide part 523*a* which guides the terminal 512 induced to the pressed surface 521 and has a parallel surface. The shallow groove 524 has also a similar guide part 524*a*, and a similar inducing part 524*b*.

FIG. 7 is a view showing a state before and after bending a terminal according to a prior art, wherein 7A is a partial perspective view showing a state before bending a terminal, 7B is a partial perspective view showing a state after the bending, and 7C is a plan view of FIG. 7B. Also, FIG. 8 is a view describing conditions in bending a terminal according to a prior art, and FIG. 9 is a view describing conditions in pressure-fitting a terminal into a substrate according to a prior art.

It is common that respective terminals 512 are molded so that, after a material is punched out by a press, and a flat plate-shaped connector terminal material 512' having a terminal width W as shown in FIG. 7A is molded, the material is inserted into a through hole 513 of a housing 511 of a connector 510 supported on a supporting base 50 as shown in FIG. 8, the material is bent in a right-angled direction at a prescribed bending radius R by pressing the tip end side thereof by a presser 570 as shown in the same drawing. At this time, as shown in FIGS. 7B and 7C, it has been known that the terminal width W' of the above-described bent part 512*c* is made wider than the terminal width W of the other parts, that is, flat parts which are not bent, (that is, W'.W).

In a conventional connector fixture 520, the distance between the comb-teeth is usually widely set according to the extending terminal width W'. However, in this case, since the clearance between the body portion of the terminal 512 and the inner side surface of the guide portion 523*a* is increased, an accurately vertical posture of the terminal 512 cannot be maintained as shown in FIG. 9A when pressure-fitting the terminal 512 into the penetrating hole 532 of the substrate 530 , and as shown in FIG. 9B, the terminal 512 will be turned and moved centering around the portion 512*c* bent by the pressure-fitting part 512*a* of the terminal 512 between wide comb teeth. And, in the worst case, there is a problem in that it is difficult to press-fit the terminal to the penetrating hole 532 of the substrate 530 , and the yield of the product decreases.

SUMMARY OF THE INVENTION

It is an object of the invention to provide a connector terminal material which can easily set a connector fixture and improve the yield of the product. It is another object of the invention to provide a connector terminal, a method for producing a connector terminal and a method for producing a substrate with a connector.

According to one aspect of the invention, a connector terminal material which extends in one direction including: an intermediate part including a specified part which is bent to form a connector terminal; a notched part provided at both end portions of the intermediate part in a width direction of the connector terminal which is orthogonal to a direction along which the bending is performed, wherein the specified part is formed by the notched part of the connector terminal is made narrower in width than a portion adjacent to the specified part.

According to another aspect of the invention, the width of the specified part is set roughly to the same width as that of parts adjacent to the specified part when the specified part is bent to the final angle.

According to another aspect of the invention, a method for producing a connector terminal material, including: molding a connector terminal material; and forming a connector terminal which is bent at the specified part by bending the connector terminal material at the specified part.

According to another aspect of the invention, in the method for producing a connector terminal material further comprising: molding a plate material shaped so that, by punching out a metal plate, a plurality of the connector terminal materials are juxtaposed in the terminal width direction and the respective specified parts of the respective connector terminal materials are connected to each other by means of a carrier portion extending along the terminal width direction; and dividing the connector terminal materials from each other and simultaneously forming a notched part on the specified parts of the connector terminal materials thus divided, by punching out the carrier portion in the plate material and portions corresponding to the notched part at both sides of the carrier portion.

According to another aspect of the invention, a method for producing a substrate with a connector, including:

producing a connector terminal material, which has a flange part the inner side of the tip end thereof is swelled in the terminal width direction; forming a connector terminal by bending the connector terminal material at the specified part with the connector terminal material implanted in a connector housing fixed on a substrate; and inserting the connector terminal into a grooved part of a fixture having a grooved part which is narrower than the flange part of the connector terminal and wider than the other parts thereof and fitting the tip end of the connector terminal into a hole part of the substrate while pressing the flange part at the edge of an open end of the grooved part of the fixture.

According to another aspect of the invention, the method of producing the substrate with a connector terminal, further including: molding a plate material shaped so that, by punching out a metal plate, a plurality of the connector terminal materials are juxtaposed in the terminal width direction and the respective specified parts of the respective connector terminal materials are connected to each other by means of a carrier portion extending along the terminal width direction; and dividing the connector terminal materials from each other and simultaneously forming a notched part on the specified parts of the connector terminal materials thus divided, by punching out the carrier portion in the plate material and portions corresponding to the notched part at both sides of the carrier portion.

According to the structure, since the connector terminal materials can be divided from each other and notched parts are formed at specified parts of the connector terminal materials thus divided, by which the connector terminal materials are made narrower, by only the step of punching the carrier parts and the portions corresponding to the notched parts at both sides of the corresponding carrier parts after a plate material in which a plurality of connector terminal materials are linked like a chain in the terminal width direction via the carrier parts, it is possible to mass-produce connector terminal materials with a few steps at high efficiency.

According to another aspect of the invention, a connector terminal including: an intermediate part bent in the lengthwise direction; a swelling part is formed, which swells in the terminal width direction orthogonal to the bending direction, at the bending part; a flange part shaped so as to swell in the terminal width direction is formed at an inner portion of the terminal tip end part so that it becomes wider than the swelling part; and a widened part which is narrower than the flange part and wider than the other parts is formed at at least one portion in an area between the flange part and the swelling part.

According to another aspect of the invention, in the connector terminal, the widened part includes a widened part formed at a position close to the flange part.

According to another aspect of the invention, a method for producing a substrate with a connector, including:

inserting a connector terminal into a grooved part of a fixture having the grooved part which is wider than the widened part of the connector terminal and narrower than the flange part of the corresponding connector terminal; and fitting the tip end of the connector terminal into a hole part of a substrate while pressing the flange part at the edge part of an open end of the grooved part of the fixture.

According to another aspect of the invention, if the connector terminal is inserted into a grooved part of a fixture having the grooved part which is wider than the widened part of the connector terminal and narrower than the flange part of the corresponding connector terminal, and the tip end of the connector terminal is fitted into a hole part of a substrate while pressing the flange part at the edge part of an open end of the grooved part of the fixture, the connector terminals can be supported at least two points, which are the swelling part and the widened part thereof, when being guided by the grooved part of the fixture, wherein a stabilized posture can be secured. At this time, the contacting force between the connector terminal and the grooved part decreases, and at the same time, the tip end of the connector terminal hardly turns and moves with respect to the substrate. Resultantly, production of substrates with a connector can be achieved, by which fitting of the connector terminal into the substrate can be facilitated and yield of the products can be improved.

Therefore, it is further preferable that the widened part and swelling part will have roughly the same width.

In addition, if the above-described widened part includes a widened part formed at a position in the vicinity of the flange part in the connector terminal, the span between the above-described two points is increased, and a further stabilized guiding posture can be brought about.

As a result, it is easy to engage the connector terminal into the substrate. The producing method of the substrate with a connector realized to improve the yield of a product.

The connector terminals can be supported at least two points, which are the swelling part formed by bending and the widened part thereof, when being guided by the grooved part of the fixture, wherein a stabilized posture can be secured in the press-fit connector. By using the press-fit connector, the producing method of the substrate with a connector can improve the yield of a product.

BRIEF DESCRIPTION OF THE DRAWINGS

These and other objects and advantages of this invention will become more fully apparent from the following detailed description taken with the accompanying drawings in which:

FIG. 8 is an illustration showing a state of bending a

DESCRIPTION OF THE PREFERRED EMBODIMENTS (Embodiment 1)

Figure 1A:
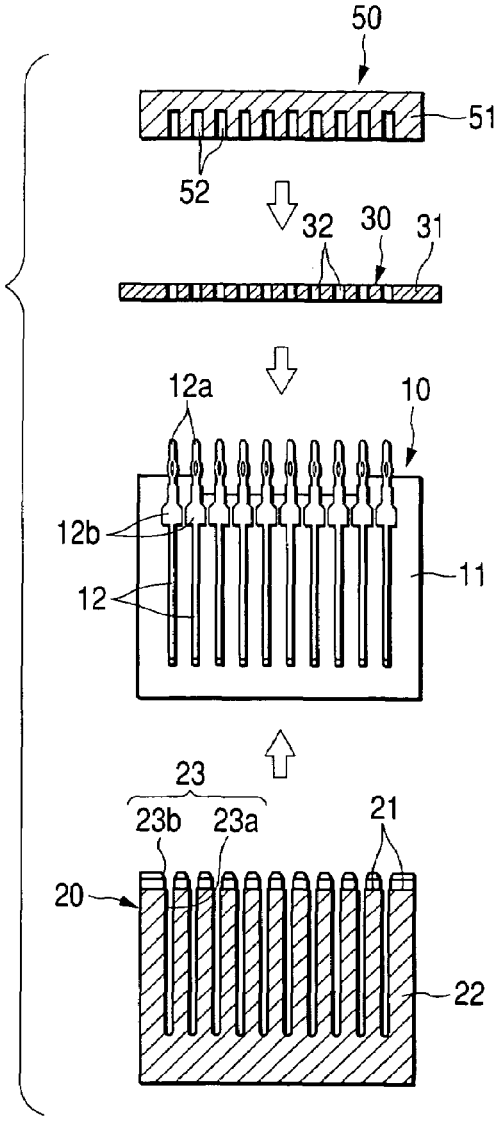
FIG. 1A is a front view including a section along a terminal array of a front side showing a state before a terminal of a press-fit connector of Embodiment 1 of the invention is press-fitted to a substrate.
Figure 1B:
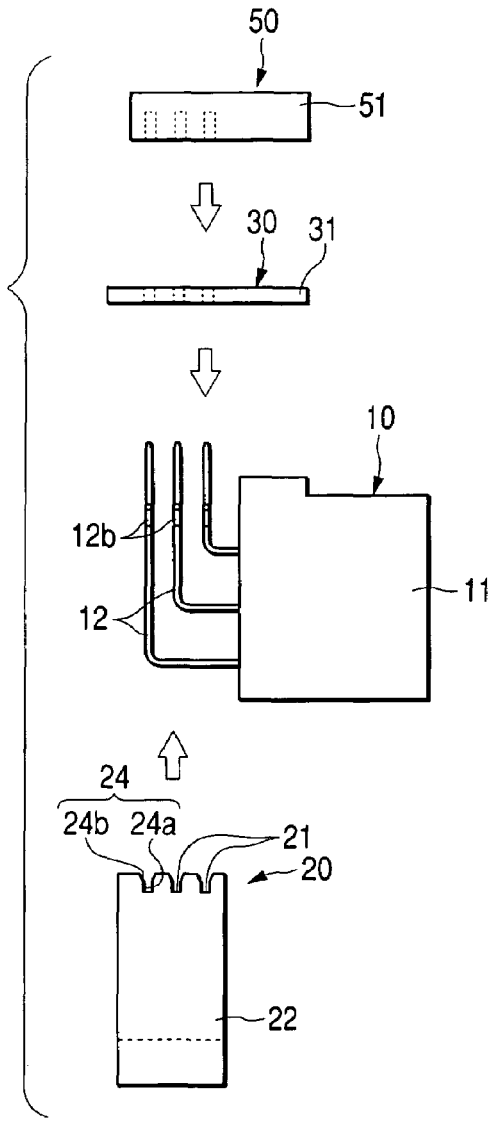
FIG. 1B is a side view showing a state before a terminal of a press-fit connector of Embodiment 1 of the invention is press-fitted to a substrate.

FIG. 1 is an illustration showing a state before a terminal of a press-fit connector of Embodiment 1 of the invention is press-fitted to a substrate. FIG. 1A is a front view including a section along a terminal array of a front side. FIG. 1B is a side view.

Figure 2C:
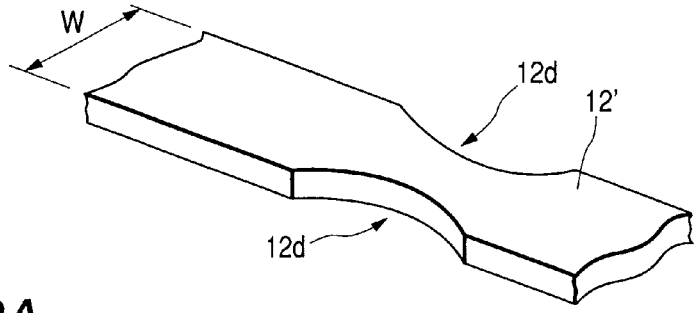
FIG. 2C is a partial perspective view before bending the terminal.
Figure 2A:
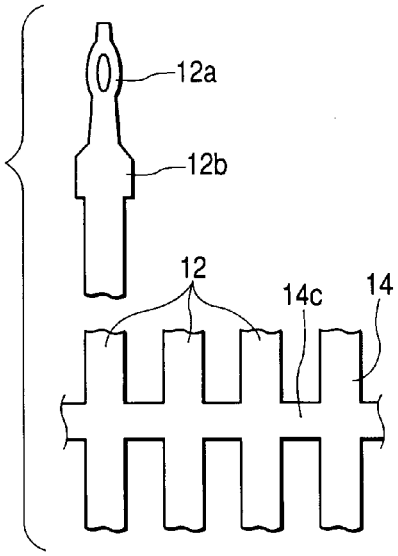
FIG. 2A is a plan view showing a shape example of a plate material to be punched out to mold a connector terminal plate.
Figure 2D:
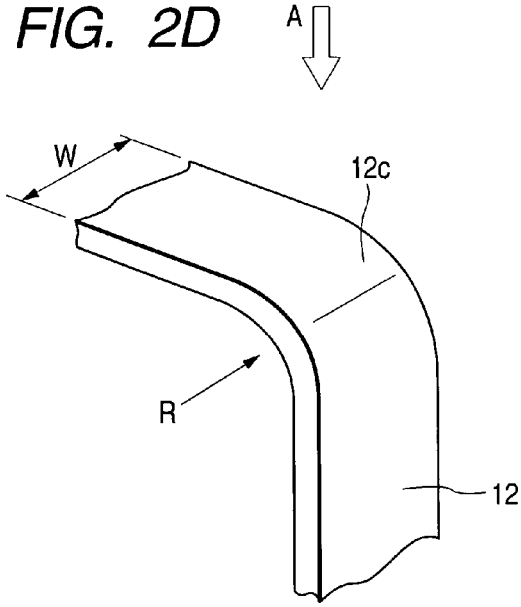
FIG. 2D is a partial perspective view after the bending is finished.

FIG. 2 is a view showing a state before and after bending a terminal according to Embodiment 1, wherein 2A is a plan view showing a shape example of a plate material to be punched out to mold a connector terminal plate, 2B is a plan view showing a punching process with respect to the plate material, 2C is a partial perspective view showing a state before bending the terminal, 2D is a partial perspective view showing a state after the bending is finished, and 2E is a plan view showing the terminal shown in FIG. 2D.

Figure 3:
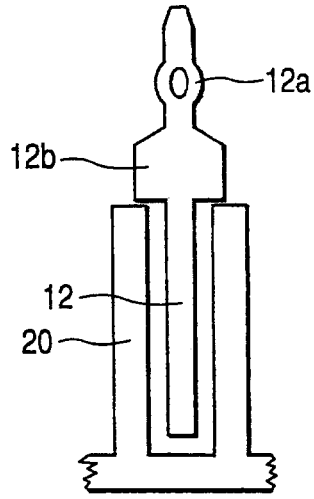
FIG. 3 is an illustration showing a state of setting the terminal of Embodiment 1 to a fixture.

FIG. 3 is an illustration showing a state of setting the terminal of Embodiment 1 to a fixture. Void arrow marks shown in FIG. 1A, 1B show the mounting direction of each part at the time of press-fitting.

In FIG. 1A and FIG. 1B, numeral 10 designates a press-fit connector as one example of a connector, and numeral 20 designates a connector fixture for terminal press-fitting of the press-fit connector 10. Numeral 30 designates a printed circuit board as a substrate, and numeral 50 designates a substrate fixture.

As shown FIG. 1, the press-fit connector 10 is provided with a synthetic resin housing 11 in which the entire shape is substantially rectangular parallelepiped, and pin-shaped metal terminals 12 (corresponding to a connector terminal) extending in parallel from the housing 11. In FIG. 1, each terminal 12 is projected out from the housing 11 in a horizontal direction, and is bent upwardly and perpendicularly such that each terminal 12 is formed in an L-shape in a side view. Three terminals are arranged in the vertical direction (in the direction perpendicular to the plane of FIG. 1A, and in the right and left direction of FIG. 1B in a plan view, and ten terminals are arranged in the lateral direction (in the right and left direction of FIG. 1A, and in the direction perpendicular to the plane of FIG. 1B) such that the terminals 12 do not mutually interfere. The shape and number of each terminal 12 are different according to the type and size of the press-fit connector 10.

An elastic part 12*a* swelled in a needle shape is formed at the vicinity of the end part of each terminal 12 such that each terminal 12 can be elastically press-fitted to each penetrating hole 32(corresponding to a hole part) of the printed circuit board 30 . A flange part 12*b* is formed at the intermediate part of the terminal 12, and the flange part 12*b* overhung from the terminal body in the right and left direction terminal width direction) is hooked on a pressed surface 21 as the edge part of the open end of the groove part of the connector fixture 20.

The connector fixture 20 supports each terminal 12 at the time of press-fitting. The connector fixture 20 is provided with a metal fixture body 22 in which the shape is substantially rectangular parallelepiped, deep grooves 23 as a groove part carved in the fixture body 22 so as to be lined in the lateral direction, and shallow grooves 24 carved so as to be lined in the vertical direction. Therefore, the fixture body 22 is made into a deep comb-teeth shape in a front view, and is made into a shallow comb-teeth shape in a side view.

Herein, the deep groove 23 inductively guides each terminal 12, and positions the flange part 12*b* in the lateral direction (the terminal's width direction). The shallow groove 24 inductively guides each terminal 12, and positions the flange part 12*b* in the vertical direction (a terminal thickness direction).

Therefore, the deep groove 23 and the shallow groove 24 have inducing parts 23*b* and 24*b* having slope surfaces formed to taper upwardly in FIG. 1, and guide parts 23*a* and 24*a* having parallel surfaces. When the connector 10 is descended, and the terminal 12 is inserted into the connector fixture 20, each terminal 12 is smoothly guided along the inducing parts 23*b* and 24*b* and the guide parts 23*a* and 24*a*. Thereby, the flange part 12*b* is accurately lined up in both vertical and horizontal directions on the pressed surface 21.

Particularly, the guide surface 23*a* of the deep groove 23 has a groove width which is narrower than that of the flange part 12*b* and is wider than that of the other part including the bending part 12*c* so as to smoothly guide the terminal body under the flange part 12*b* for a relatively long distance.

The printed circuit board 30 has a thin plate-like substrate body 31, and penetrating holes 32 for penetrating the substrate body 31 at positions corresponding to the terminals 12.

The substrate fixture 50 is intended to press the printed circuit board 30 at the time of press-fitting, and has a thick plate-like fixture body 51. The fixture body 51 has bottomed holes 52 for inserting the respective terminals 12 penetrating holes 32 of the printed circuit board 30 and protecting the terminals.

Hereinafter, a description is given of a method for producing the press-fit connector 10 and a substrate with the same connector 10.

First, a connector terminal material 12' as shown in FIG. 2C is molded. The connector terminal material 12' extends in one direction and is to form a terminal 12 in which an intermediate part (specified) is bent by bending the intermediate part. However, the connector terminal material 12' is featured in that the above-described intermediate part has a smaller width than the width W of the portion adjacent to the specified part by being provided with a notched part 12 formed at both end parts of the terminal width direction orthogonal to the direction along which the above-described bending is carried out. When producing the connector terminal plate 12', for example, a flat plate may be molded, which has, a notched part 12*d* at both end sides of the terminal body of a fixed width W by punching a metal plate, which is a material by means of a press.

The following is preferable as its detailed molding method.

First, a plate material 14 shaped as shown in FIG. 2A is molded by punching a metal plate which is a material. The plate material 14 is shaped so that a plurality of the above-described connector terminal plates 12' are disposed in the terminal width direction and the above-described intermediate parts of the respective connector terminal material 12' are linked with each other by carrier parts 14*c* extending in the above-described terminal width direction. That is, in the plate material 14, a plurality of connector terminal materials 12' are connected to each other via the carrier parts 14*c* in the terminal width direction. The positions of the respective carrier parts 14*c* are established at intermediate parts of the respective connector terminal materials 12', that is at the positions where specified parts in which a bending process is intended to be performed, are linked with each other.

Figure 2B:
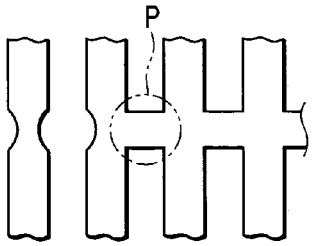
FIG. 2B is a plan view showing a punching process with respect to the plate material.

Next, the carrier parts 14*c* of the plate material 14 and portions corresponding to the above-described notched parts 12*d* at both sides of the carrier parts 14*c* are punched by a punch P as shown in FIG. 2B. By the punching process, it is possible to separate or divide the connector terminal materials 12', which have been linked with each other. Simultaneously, the above-described notched parts 12*d* may be formed at specified parts of the connector terminal materials 12 thus divided, and the corresponding specified parts may be made narrower. For example, if a punch P whose section is circular as shown in the drawing is used, it is possible to simultaneously form arcuately notched parts 12*d* at one side end part of one connector terminal plate 12' of the connector terminal plates 12' which are divided from each other, and at one side end part of the other connector terminal plates 12' adjacent thereto, respectively.

Figure 2E:
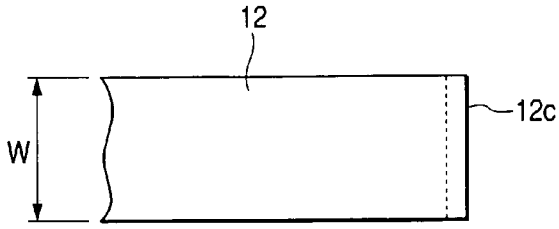
FIG. 2E is a plan view showing the terminal shown in FIG. 2D.
Figure 8:
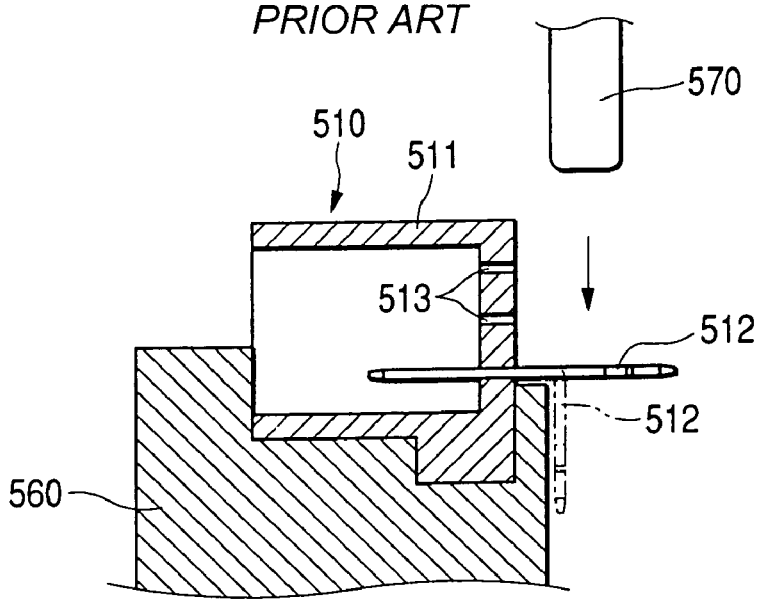
FIG. 8 PRIOR ART
Figure 9A:
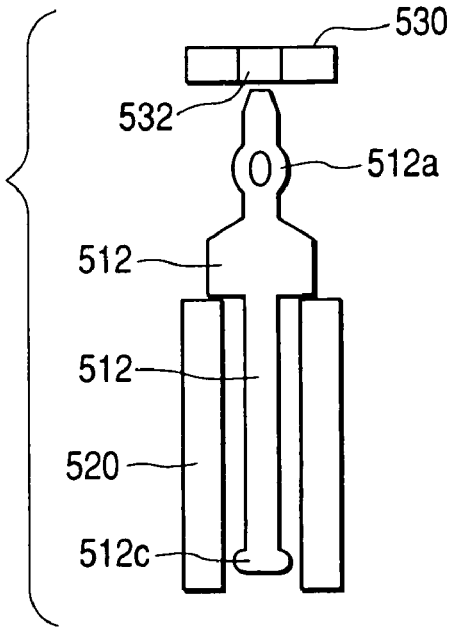
FIG. 9A PRIOR ART
FIGS. 9A and 9B illustrations showing a state of setting the conventional terminal to a fixture.
Figure 9B:
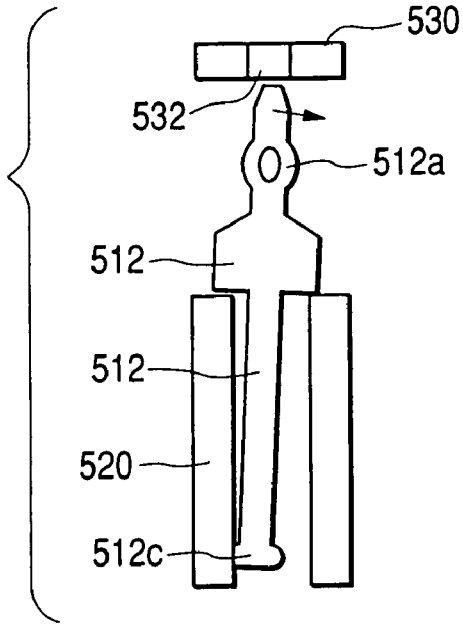
FIG. 9B PRIOR ART

After the connector terminal material 12' is formed, for instance, in the same manner as in FIG. 8, the intermediate position at which the notched parts 12*d* are formed is bent in a predetermined radius R in a right-angled direction with the connector terminal material 12' inserted into the housing 11. As shown in FIG. 2C, FIG. 2D, and FIG. 2E, the bent part (bending part) 12*c* has the almost same width as that of a non-bending part, that is a portion except for the bent part, and the swelling of the bending part 12*c* of each terminal 12 at the time of bending is suppressed.

Strictly speaking, since the swelling amount changes to a degree according to processing conditions (spring back amount or the like), the bending part may swell slightly after the bending process, and oppositely, the concave part may remain slightly. However, the slight swelling or the existence of the concave part can be disregarded compared with the case in which the concave part is not formed at all as in the conventional example.

Each terminal 12 is brought into contact with the pressed surface 21 and is supported by inserting each terminal 12 into the deep groove 23 and shallow groove 24 of the connector fixture 20 from the root side of the terminal body having the bending part 12*c* of each terminal 12 of the press-fit connector 10 in the height direction of the housing 11 in the supporting state, the main body of the terminal is inserted into each deep groove 23 of the connector fixture 20, the flange portion 12*b* is inserted into the shallow groove 24, and the back end of the inserted flange portion 12*b* is abut with a press-fit surface 21, that is a bottom face of the shallow groove 24 which is positioned at an edge portion of the open terminal of the deep groove 23.

Then, each terminal 12 is press-fitted to the printed circuit board 30 by pressing the substrate fixture 50 (then, the pressed surface 21 of the connector fixture 20 presses the back portion of the flange portion of each terminal 12 from backward)with the printed circuit board 30 with which the substrate fixture 50 is brought into contact from the back thereof and each terminal 12 supported by the connector fixture 20 of the press-fit connector opposed to each other.

Thus, as shown in FIG. 3, when each terminal 12 is guided by the deep groove 23 of the connector fixture 20 in the press-fit connector 10 of Embodiment 1, each terminal 12 is supported in almost even force across the full length thereof, and thereby the guide posture is stabilized.

In that case, the contact force between each terminal 12 and inside surface of the guide surface 23*a* of the deep groove 23 decreases, and the end of each terminal 12 is hardly turned and moved to penetrating hole 32 of the printed circuit board 20. As a result, it is easy to press-fit each terminal 12 to the penetrating hole 32 of the printed circuit board 20, and the yield of a product of a substrate with a connector is improved in the producing method of the connector.

Since an intermediate portion of each terminal 12 of the press-fit connector 10 has a narrow width by previously forming the notched portions 12*d*, in first embodiment, the swelling of the bending part 12*c* which is formed by bending the intermediate portion of each terminal 12 is almost lost in each terminal 12 of the press-fit connector 10. Thus, the groove width of the deep groove 23 of the connecter fixture 20 can be much narrower, so that a further miniaturization of the press-fit connector 10 can be achieved.

(Embodiment 2)

Figure 4A:
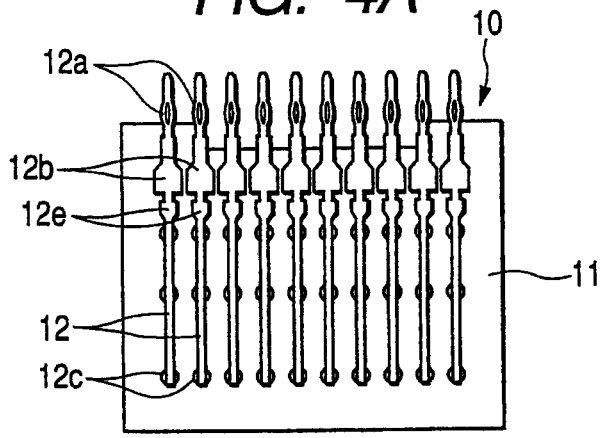
FIG. 4A is a front view including a section along a terminal array of a front side before a terminal of a press-fit connector of Embodiment 2 of the invention is press-fitted to a substrate.
Figure 4B:
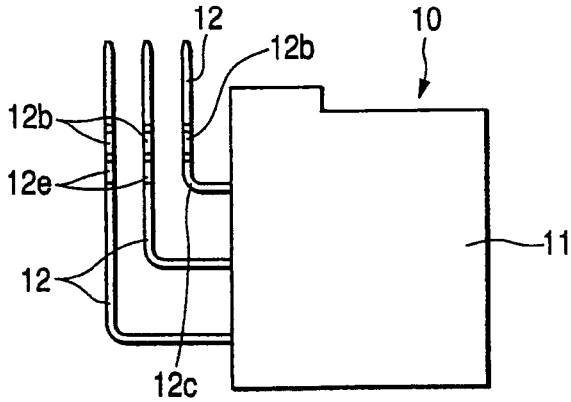
FIG. 4B is a side view before a terminal of a press-fit connector of Embodiment 2 of the invention is press-fitted to a substrate.
Figure 5:
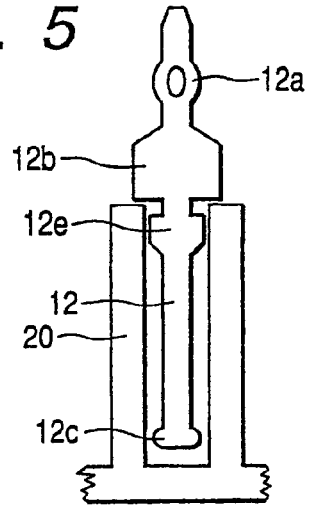
FIG. 5 is an illustration showing a state of setting the terminal of Embodiment 2 to a fixture.
Figure 6A:
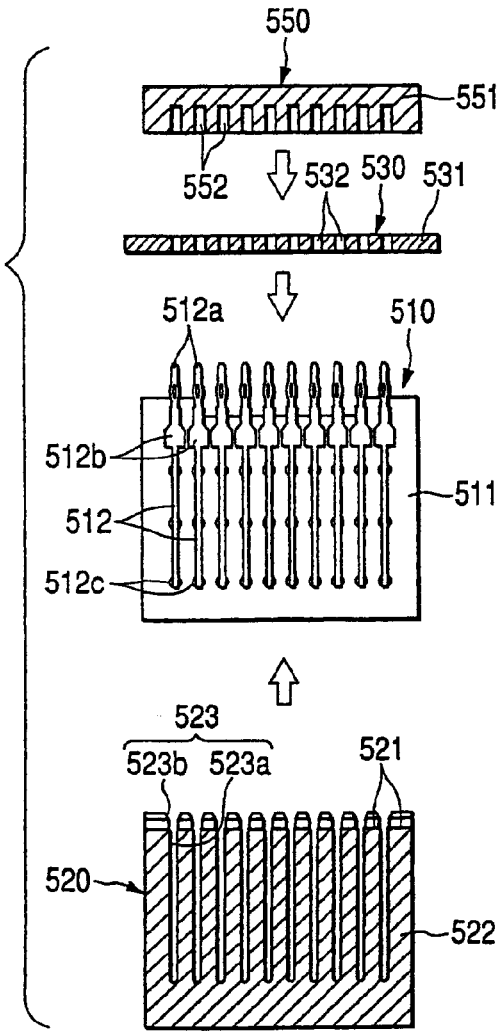
FIG. 6A PRIOR ART
FIG. 6A is a front view including a section along a terminal array of a front side before a terminal of a conventional press-fit connector is press-fitted to a substrate.
Figure 6B:
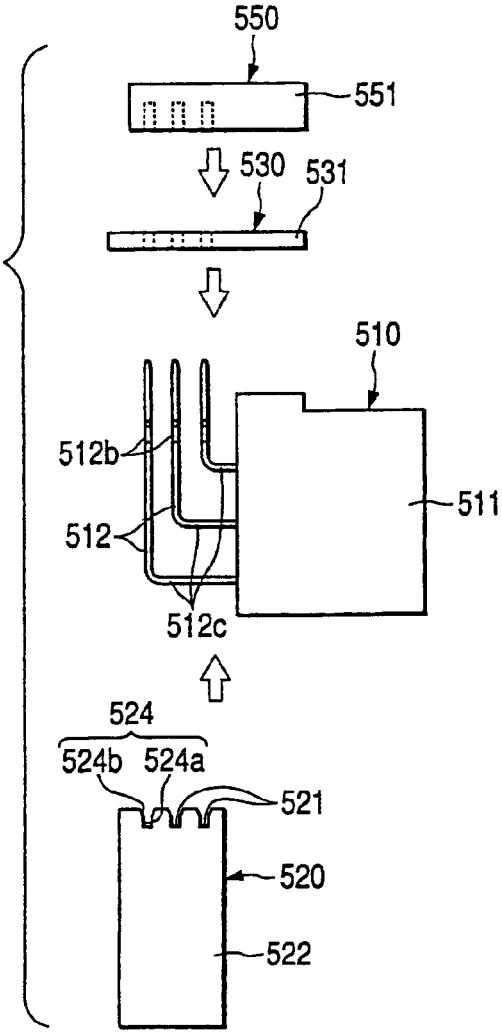
FIG. 6B PRIOR ART
FIG. 6B is a side view before a terminal of a conventional press-fit connector is press-fitted to a substrate.

FIG. 4 is an illustration showing a state before a terminal of a press-fit connector of Embodiment 2 of the invention is press-fitted to a substrate. FIG. 4A is a front view including a section along a terminal array of a front side. FIG. 4B is a sideview. FIG. 5 is an illustration showing a state of setting the terminal of Embodiment 2 to a fixture. Hereinafter, an explanation of elements which are common to Embodiment 1 is omitted.

As shown in FIG. 4, the bent part (bending part) 12*c* of the terminal body of the terminal 12 of Embodiment 2 swells in the specified direction crossing at right angles of the bending direction by bending the intermediate part in the longitudinal direction.

As shown in FIG. 5, the bent portion 12 forms the swelling portion by swelling in a direction of the terminal width crossing the at right angles bending direction.

A flange part 12*b* swelling in the above-described terminal width direction is formed at this side (inner side) of the tip end part of the terminal 12 so that the flange part becomes wider than the above-described swelling part. Also, a widened part 12*e* in which both side parts thereof in the terminal width direction protrude outwardly is formed at at least one point (point in the vicinity of the above-described flange part 12*b* in the illustrated example) in an area between the flange part 12*b* and the above-described swelling part, and the widened part 12*e* is narrower than the above-described flange part 12*b* and is made wider than the other portions including the bending part 12*c*. It is further preferable that the width of the widened part 12*e* is roughly the same as the width of the above-described swelling part.

Although the widened part 12*e* is shaped so that the flange part 12*b* is turned upside down, it is not limited to this shape. However, with respect to the terminal body, the upside is made properly arcuate (not illustrated), and an inclined portion is provided at the underside thereof, whereby stress concentration is suppressed as much as possible.

The widened part 12*e* is prepared at the position in the vicinity of the flange part 12*b* in the illustrated example and is formed at a position right therebelow. However, the forming position thereof may be optionally set in an area from the flange part 12*b* to the bending part 12*c*. Also, the widened parts 12*e* may be provided by a plurality. However, if the widened part 12*e* positioned in the vicinity of the above-described flange part 12*b* is included as the widened part 12*e*, the span between the supporting points can be secured to be large when the terminal 12 is inserted into the deep groove 23 of the connector fixture 20 and the terminal body is supported on the guide surface 23*a* of the deep groove 23. As a result, it is advantageous that a further stabilized guiding posture can be secured.

Hereinafter, a press-fit connector 10 and a method for producing a substrate with a connector using the press-fit connector 10 of Embodiment 2 will be described.

Figure 7A:
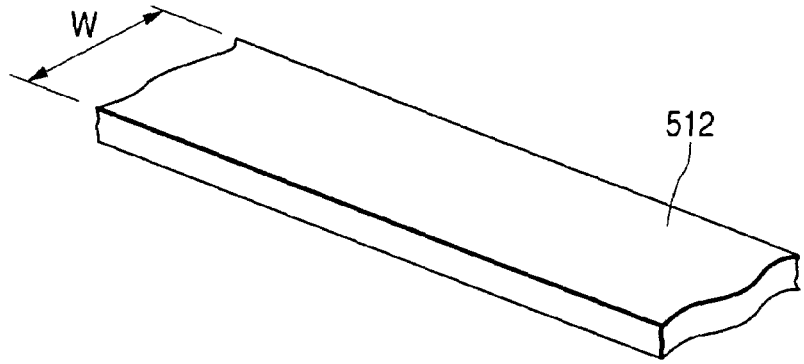
FIG. 7A PRIOR ART
FIG. 7A is a partial perspective view showing a state before bending the conventional terminal.
Figure 7B:
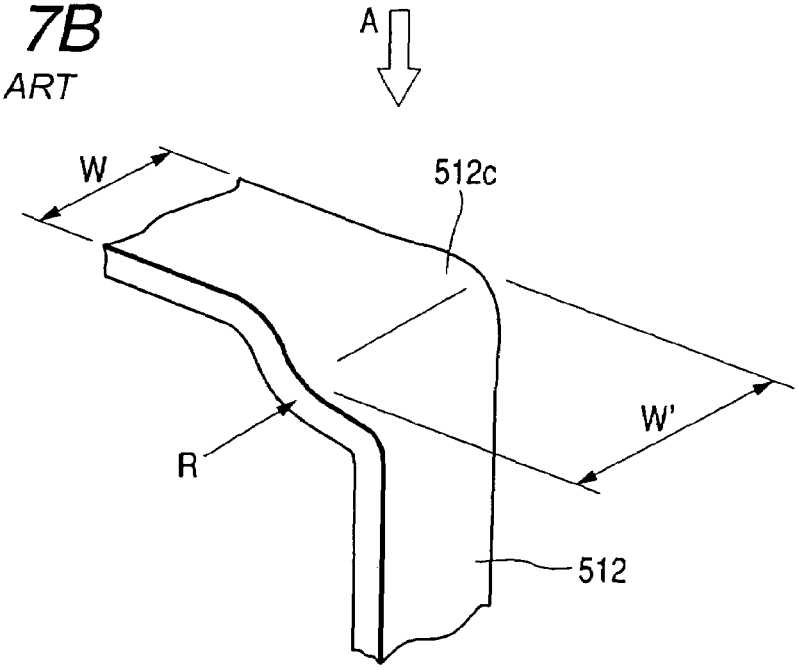
FIG. 7B PRIOR ART
FIG. 7B is a partial perspective view showing a state after bending the conventional terminal.
Figure 7C:
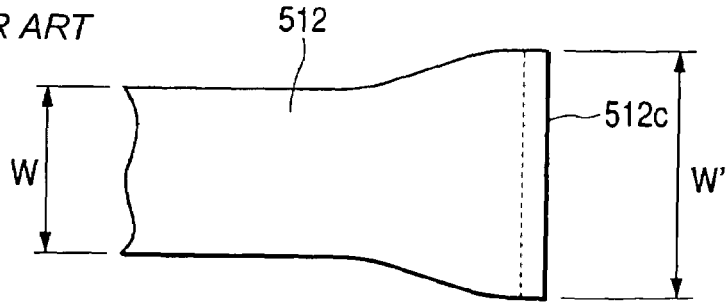
FIG. 7C PRIOR ART
FIG. 7C is a plan view of FIG. 7B.

First, a connector terminal material which extends in one direction, and of which the intermediate position (specified position) is bent to form a terminal 12 is formed. As shown in FIG. 7A, in this embodiment, the flange portion 12*b* and the widened part 12*e* are formed, but basically, as well as connector terminal material 51, the flat connector terminal material is formed with a predetermined width W with respect to a longitudinal direction.

After the flat connector terminal material is formed, for instance, in the same manner as in FIG. 8, the intermediate position is bent in a predetermined radius R in a right-angled direction with the connector-terminal material inserted into the housing 11. As shown in FIG. 4A and FIG. 4B, the swelling part due to bending is formed on the bent part (bending part) 12*c*. The widened part 12*e* is formed above the swelling part. However, the widened part is not formed on the terminal 12 at the right end shown in FIG. 4B since the bending part 12*c* is adjacent to the flange part 12*b*.

And, as in the case of the above-described embodiment 1, respective terminals 12 are inserted from the root side of the terminal body where the bending parts 12*c* of the respective terminals 12 of the press-fit connector 10 are provided, into the deep groove 23 and shallow groove 24 of the connector fixture 20 from the height side of the housing 11, and the respective terminals 12 are thus supported. The supporting state is such that the body parts of the respective terminals 12 are inserted into respective deep grooves 23 of the above-described connector fixture 20, the flange parts 12*b* are inserted into the shallow grooves 24, and the rear end part of the flange part 12*b* is brought into contact with the bottom surface, that is, the press-fit surface 21 of the shallow groove 24 at the edge part of the open end of the above-described deep groove 23.

Thus, in a state where the respective terminals 12 of the press-fit connectors 10 supported by the connector fixture 20 and a printed circuit board 30 with which the substrate fixture 50 is brought into contact from the rear side are opposed to each other, the respective terminals 12 are press-fitted into the printed circuit boards 30 by pressing the above-described substrate fixture 50 (at this time, the pressed surface 21 of the connector fixture 20 presses the rear end part of the flange part 12*b* of the respective terminals 12 from rearward).

Thus, as shown in FIG. 5, when each terminal 12 is guided and inserted into the deep groove 23 of the connector fixture 20 in the press-fit connector 10 of Embodiment 2, each terminal 12 is supported by at least two points of the swelling part of the bending part 12*c* and the widened portion 21*e*, and the guide posture is stabilized. In that case, the contact force between each terminal 12 and guide surface 23*a* of the deep groove 23 decreases, and the end of each terminal 12 is hardly turned and, moved to the penetrating hole 32 of the printed circuit board 30 . As a result, it is easy to press-fit each terminal 12 to the penetrating hole 32 of the printed circuit board 30 , and the yield of a product of a substrate with a connector is improved in a producing method of the substrate with the connector.

In Embodiments 1 and 2, the terminal body of each terminal 12 protruding from the housing 11 of the press-fit connector 10 is perpendicularly bent to the upward side of the housing 11. However, the terminal body may be bent downward, and may not be bent perpendicularly. For instance, the terminal body may be bent at 45°.

The example of the press-fit connector 10 is described in Embodiments 1 and 2. However, the applicable scope of the invention is not limited thereto, and the invention can be applied to other kinds of connectors for a substrate such as a pin connector. However, the end of terminal 12 of the pin connector is not press-fitted to the penetrating hole 32 of the printed circuit board 30 , and the end of terminal 12 is soldered after the end of terminal 12 is engaged into the penetrating hole 32.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A press-fit connector terminal material which extends in one direction and is to be bent to a final angle, comprising:

an intermediate part including a specified part which is bent to form a connector terminal; and a notched part provided at both edge portions of the specified part in a width direction of the connector terminal, the width direction being substantially parallel to an axis about which the bending is performed, wherein the width of the specified part, as measured in the width direction of the connector terminal, is set roughly to be changed to the same width as that of parts adjacent to the specified part when the specified part is bent to the final angle.

2. A method for producing a press-fit connector terminal material, comprising:

forming a connector terminal material as recited in claim 1; and bending the connector terminal material at the specified part.

3. A method for producing a press-fit connector terminal material according to claim 2, further comprising:

forming a plate material shaped by punching out a metal plate so that a plurality of the connector terminal materials are juxtaposed in the terminal width direction and the respective specified parts of the respective connector terminal materials are connected to each other by means of a carrier portion extending along the terminal width direction; and dividing the connector terminal materials from each other and simultaneously forming a notched part on the specified parts of the connector terminal materials thus divided, by punching out the carrier portion in the plate material and portions corresponding to the notched part at both sides of the carrier portion.

4. A method for producing a substrate with a press-fit connector, comprising:

producing a connector terminal material according to claim 1, in which an inner side of a tip end of the flange part is swelled in the terminal width direction;

forming the connector terminal by bending the connector terminal material at the specified part with the connector terminal material implanted in a connector housing fixed on a substrate; and inserting the connector terminal into the groove in the connector fixture which is narrower than the flange part of the connector terminal and fitting the tip end of the connector terminal into a hole part of the substrate while pressing the flange part at the edge of an open end of the grooved part of the fixture.

5. A method for producing a substrate with a press-fit connector according to claim 4, further comprising:

forming a plate material shaped so that, by punching out a metal plate, a plurality of the connector terminal materials are juxtaposed in the terminal width direction and the respective specified parts of the respective connector terminal materials are connected to each other by means of a carrier portion extending along the terminal width direction; and dividing the connector terminal materials from each other and simultaneously forming a notched part on the specified parts of the connector terminal materials thus divided, by punching out the carrier portion in the plate material and portions corresponding to the notched part at both sides of the carrier portion.

* * * * *